US006195997B1

(12) United States Patent
Lewis et al.

(10) Patent No.: US 6,195,997 B1
(45) Date of Patent: Mar. 6, 2001

(54) ENERGY CONVERSION SYSTEM

(75) Inventors: Larry Lewis, Houston; Walter D. Monroe, Kingwood; James H. Pinion, Houston, all of TX (US)

(73) Assignees: Lewis Monroe Power Inc.; (KKA) Lewis Monroe Piniow, Inc, both of Houston, TX (US)

( * ) Notice: Subject to any disclaimer, the term of this patent is extended or adjusted under 35 U.S.C. 154(b) by 0 days.

(21) Appl. No.: 09/524,714

(22) Filed: Mar. 14, 2000

Related U.S. Application Data

(60) Provisional application No. 60/129,428, filed on Apr. 15, 1999.

(51) Int. Cl.[7] ..... F01K 17/00

(52) U.S. Cl. ..... 60/648; 60/649; 60/651; 60/671

(58) Field of Search ..... 60/648, 649, 651, 60/671

(56) References Cited

U.S. PATENT DOCUMENTS 5,029,444 * 7/1991 Kalina ..... 60/649 X
5,077,030 * 12/1991 Yogev ..... 60/649 X (List continued on next page.)

*Primary Examiner*—Hoang Nguyen
(74) *Attorney, Agent, or Firm*—Martin L. McGregor

(57) ABSTRACT

The invention provides a method and apparatus for recovering work from a heat source and providing a cooling source that comprises:

a. providing a selected working fluid comprising at least two components; to a first low pressure pump;

b. feeding the selected working fluid to a dividing means;

c. dividing the working fluid into a first stream and a second stream, d. feeding the first stream at a first low pressure to a first heat transfer zone to transfer heat to the working fluid stream heating the stream to a higher temperature, e. feeding the higher temperature stream to a separation means, f. separating a volatile component enriched stream and a volatile component depleted stream;

g. heating the volatile component enriched stream;

h. feeding the volatile component enriched stream to an expansion means i. expanding the volatile component enriched stream to a lower temperature and pressure;

j. feeding the expanded lower temperature and pressure volatile component enriched stream to a mixing means;

k. feeding the volatile component depleted stream to the mixing means;

l. feeding the second working fluid stream to a high pressure pump and then to a second heat exchange zone wherein heat is transferred to the second working fluid stream to produce a higher temperature and pressure condition of the second working fluid stream;

m. work expanding the higher temperature and pressure second working fluid stream to convert a portion of the heat energy to mechanical energy;

n. feeding the work expanded second stream to the mixing means;

o. mixing the streams to provide a combined working fluid stream;

p. returning the combined working fluid stream to the feed-line of the first low pressure pumping stage to provide the selected working fluid.

Preferably, the selected working fluid is selected from the group consisting of ammonia and water; sulfur dioxide and water; mixed hydrocarbons; ammonia and brine; or sulfur dioxide and brine. More preferably, the selected working fluid comprises ammonia and water or ammonia, water and salts. Most preferably, the selected working fluid consists essentially of ammonia and water. In an especially preferred embodiment, the volatile component enriched stream is substantially a pure component. The invention also provides an apparatus specially configured to carry out the method claimed above.

15 Claims, 5 Drawing Sheets

U.S. PATENT DOCUMENTS 5,136,854 * 8/1992 Abdelmalek ..... 60/651 X 5,440,882 * 8/1995 Kalina ..... 60/651 X

* cited by examiner

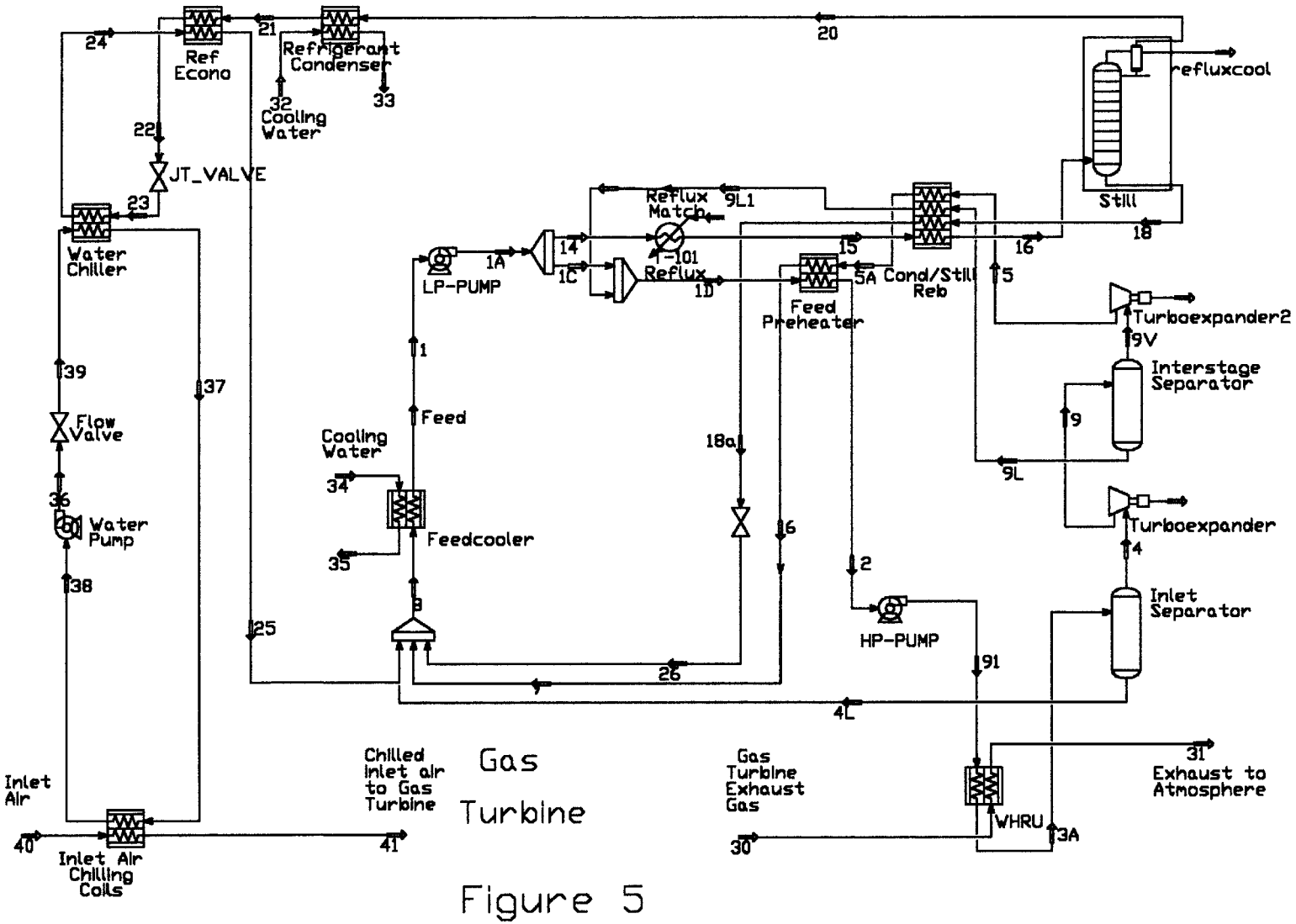
refluxcool
Still
18
Turbaexpander2
9V
Interstage Separator
Turbaexpander
4
Inlet Separator
31
Exhaust to Atmosphere
3A
WHRU
16
5
9L
91
Cond/Still Reb
5A
HP-PUMP
2
4L
20
15
Feed Preheater
6
Gas Turbine Exhaust Gas
30
9L1
Reflux Mata
T-101
Reflux
1D
18a
26
14
1C
1A
LP-PUMP
Feed
Feedcooler
8
Gas Turbine
Figure 5
Chilled Inlet air to Gas Turbine
41
Refrigerant Condenser
33
Cooling Water
34
35
32
Cooling Water
21
25
Ref Econo
JT_VALVE
137
22
23
24
Water Chiller
39
Flow Valve
36
Water Pump
38
Inlet Air Chilling Coils
Inlet Air
40

ENERGY CONVERSION SYSTEM

RELATED APPLICATIONS

This application is a continuation in part of U.S. provisional application Ser. No. 60/129,428 filed Apr. 15, 1999.

TECHNICAL FIELD

This invention pertains to the field of energy conversion and specifically to the conversion of heat energy to mechanical energy.

BACKGROUND OF THE INVENTION

Energy conversion engines have long been employed to recover process heat and convert it to mechanical energy as in the familiar Rankine cycle. Typical systems are in a series of patents by Alexander Kalina and various coworkers such as U.S. Pat. Nos. 5,095,708; 5,029,444; 4,982,568; 4,899,545; 4,732,005; 4,604,867; 4,586,340; 4,548,043; and 4,489,563. Scharpf, U.S. Pat. No. 5,842,345 teaches the use of two component working fluids, preferring ammonia and water, in a heat recovery method. DeVault U.S. Pat. No. 5,555,738, teaches use of an ammonia water refrigeration system to cool the inlet air of a gas turbine for improved efficiency.

The art has not heretofore recognized the unexpected advantage of using a two component working fluid which is separated into it's a more volatile and a less volatile component and the more volatile component used in a refrigerant loop to provide refrigeration capacity then recombined with the less volatile component to provide a multi-component working fluid for heat recovery.

SUMMARY OF THE INVENTION

The invention may be described in several ways as alternate embodiments of the same novel discovery. In one embodiment, the invention provides a method of recovering energy that comprises:

a. providing a selected working fluid comprising at least two components to a first pump;

b. feeding the selected working fluid to a dividing means;

c. dividing the working fluid into a first stream and a second stream, d. feeding the first stream at an intermediate pressure to a first heat transfer zone to transfer heat to the working fluid stream thereby heating the stream to a higher temperature, e. feeding the higher temperature stream to a separation means, f. separating a volatile component enriched stream and a volatile component depleted stream;

g. cooling the volatile component enriched stream;

h. further cooling the volatile component enriched stream in a heat exchanger;

i. feeding the volatile component enriched stream to an expansion means;

j. expanding the volatile component enriched stream to a lower temperature and pressure;

k. feeding the expanded lower temperature and pressure volatile component enriched stream to a heat exchanger where the volatile enriched stream is partially or completely vaporized by heat exchange while absorbing heat from an external stream;

l. feeding the at least partially vaporized volatile component enriched stream to a heat exchanger;

m. feeding the volatile component enriched stream to the mixing means;

n. feeding the volatile component depleted stream to the mixing means;

o. feeding the second working fluid stream to a second pump and increasing the pressure of the second working fluid stream to a high pressure;

p. feeding the high pressure second working fluid stream to a second heat exchange zone wherein heat is transferred to the high pressure second working fluid stream to produce a higher temperature and pressure condition of the second working fluid stream;

q. work expanding the higher temperature and pressure second working fluid stream to convert a portion of the heat energy to mechanical energy;

r. returning the second working fluid stream to the mixer; and s. repeating the cycle as set out above.

In a preferred embodiment the method further comprises:

a. feeding the second working fluid through one or more heat exchangers to recover heat while cooling this stream;

b. feeding the work expanded second stream to the mixing means;

c. mixing the streams to provide a combined working fluid stream;

d. cooling and condensing the combined working fluid stream by heat exchanging with a bulk heat sink such as ambient air or water; and e. returning the combined working fluid stream to the feed-line of the low pressure pumping stage to provide the selected working fluid.

In another preferred embodiment the method further comprising providing multiple expansion means in series relationship and expanding the volatile component to provide a series of partially condensed working fluid intermediate fractions and passing such intermediate fractions to a reboiler.

Preferably, the selected working fluid is selected from the group consisting of ammonia and water; sulfur dioxide and water; mixed hydrocarbons; ammonia and brine; or sulfur dioxide and brine. More preferably, the selected working fluid comprises ammonia and water or ammonia, water and salts. Most preferably, the selected working fluid consists essentially of ammonia and water. In an especially preferred embodiment, the volatile component enriched stream is substantially a pure component.

In an optional embodiment the method further comprises the steps of feeding the expanded volatile component enriched stream to a second mixing means and feeding a third component into the second mixing means to provide a mixed components stream and feeding the mixed components stream to a refrigerant condenser, separating the mixed components and recycling the separated components.

The stream may also be fed back through multiple heat exchangers to further increase heat uptake and process efficiency and/or to produce a lower refrigerant temperature.

Alternate pumping arrangements can be utilized to provide the intermediate pressure stream that generates the volatile component enriched stream and the second working fluid stream Alternately the volatile enriched stream can be heat exchanged to partially or completely vaporize this stream while providing refrigeration to a separate fluid-circulating stream.

In an alternate embodiment, the invention is an energy recovery apparatus that comprises:

a. fluid conduit means connecting all components listed below;

b. a vessel for receiving a working fluid;

c. a dividing means positioned between said vessel and a low pressure pumping means;

d. a low pressure pumping means connected to receive a divided portion of a working fluid and connected on the pressure side to a first heat transfer means;

e. a separation means operably connected to the first heat transfer means and configured to separate a more volatile component of the working fluid from a less volatile component of the working fluid, having a discharge point for discharging a separated more volatile component and a discharge point for the less volatile component;

f. a heat transfer means positioned to receive the more volatile component from the separation means;

g. an expansion means connected to the heat transfer means and configured to receive a cooled more volatile component from the heat transfer means and expand said component to a lower pressure zone, thereby lowering the temperature of the more volatile component;

h. a mixing means operably connected to the separation means and configured to receive the less volatile component from the separation means and the more volatile component from the expansion means;

i. a high pressure pump means connected on its suction side to the dividing means and configured to receive a portion of the selected working fluid and connected on its high pressure side to a second heat transfer means;

j. work expansion means connected to the second heat transfer means on its high pressure side and to the mixing means on its low pressure side;

k. a heat sink means configured to provide a fully liquefied working fluid for feeding to the dividing means;

l. a working fluid comprising at least one more volatile component and a less volatile component in a ratio such that the at least one more volatile component is vaporized by heat available from the energy to be recovered in sufficient quantity to provide the desired product temperature when expanded in the expansion means while the combined working fluid can be fully condensed by the available heat sink means at pressures acceptable in the heat sink means.

In a preferred embodiment the invention further provides:

a. a second mixer connected by fluid conduit means to the expansion means to receive the expanded more volatile component stream and a third component;

b. a conduit means to convey a mixed components stream to a refrigerant condenser means and c. a separating means in fluid communication with the refrigerant condenser means and a fluid conduit means for recycling the separated components to the second mixer.

In an additional preferred embodiment the apparatus comprises a series of turbo-expanders and multiple heat recovery stages to provide additional refrigeration capacity.

In summary, the invention provides a system for energy recovery that combines an absorption refrigeration capacity with an energy recovery system using a multi-component working fluid having a more volatile component that can be separated using heat from the energy recovery system to provide a more volatile component stream in a sufficient quantity to provide a desired product temperature in the refrigeration system while simultaneously serving as a multi-component working fluid in the energy recovery system on recombination that can be fully condensed in a selected heat sink and be sufficiently vaporized by the quantity of energy to be recovered in the energy recovery system. For a given system, the quantity of energy, usually heat, available to be recovered, the desired product temperature in the refrigeration system and the available heat sink capacity for condensing the working fluid will define the requirements for the latent heat of vaporization, and the temperature and pressure conditions that must be met by the working fluid. The working fluid may be of any composition that will meet the required temperature, pressure and heat transfer requirements of the system. Alternatively, operating temperature and pressure ranges for the overall system may be defined by mechanical limitations of desired equipment, such as the maximum operational pressure of a preferred heat exchanger or the desired approach temperature for the product temperature against ambient conditions. When these additional considerations are imposed on the system, the working fluid composition will be adjusted to meet these preferred ranges. Preferred working fluids are those listed and discussed above. Ammonia water or ammonia brine fluids are especially preferred. However, those skilled in the art will recognize that in many applications other working fluids may be used to practice the invention.

In another embodiment the invention may be viewed as a method for designing an energy recovery system to provide enhanced energy recovery while at the same time providing an integrated refrigeration capacity that comprises the steps of defining a desired product temperature in the refrigeration system, defining an available heat sink, defining a quantity of energy to be recovered in an energy recovery system, defining a means for converting the quantity of energy to be recovered into a recovered energy output while also providing sufficient heat energy to separate a sufficient quantity of the more volatile component of a portion of the working fluid to provide cooling to the defined product temperature when evaporated and a less volatile component such that when the components are recombined and mixed with a second portion of the working fluid stream from the energy recovery system, the mixed fully combined working fluid stream will be fully condensed by the defined heat sink, defining a group of conditions to be meet by a multi-component working fluid, the fully condensed working fluid being divided into at least a first portion and a second portion, the first portion being substantially vaporized by contacting the energy to be recovered thereafter driving the means for energy recovery while also providing heat to separate the more volatile component from the second portion in a selected separation means and when the first portion and second portions are recombined be fully condensed by the defined heat sink capacity.

Another aspect of the invention is a preferred mode of heat exchange in the overall system which comprises the use of a series of heat exchange steps taking advantage of the variable composition ranges available when a multi-component working fluid is used to conduct heat absorption over a cooling range rather than at a single value as in single component working fluid systems. The invention provides a subsystem comprising a plurality of heat exchangers each operating at a different temperature and working fluid composition as a more volatile portion of the multi-component working fluid is sequentially vaporized and the less volatile component is fed to a subsequent heat exchanging location, the vaporized more volatile component is fed to an energy conversion means such as a turbine where it is expanded to a lower temperature and pressure to provide a desired mechanical work recovery. By using a plurality of heat exchange steps and a variable composition working fluid additional energy can be recovered from an energy recovery source.

The invention is illustrated by the specific examples set out below.

BRIEF DESCRIPTION OF THE DRAWINGS

FIG. 5 is a flow diagram for an example showing additional heat recovery steps being added to the system of FIG. 4 and the use of multiple expansion stages.

DETAILED DESCRIPTION OF THE INVENTION

EXAMPLE 1

Figure 1:
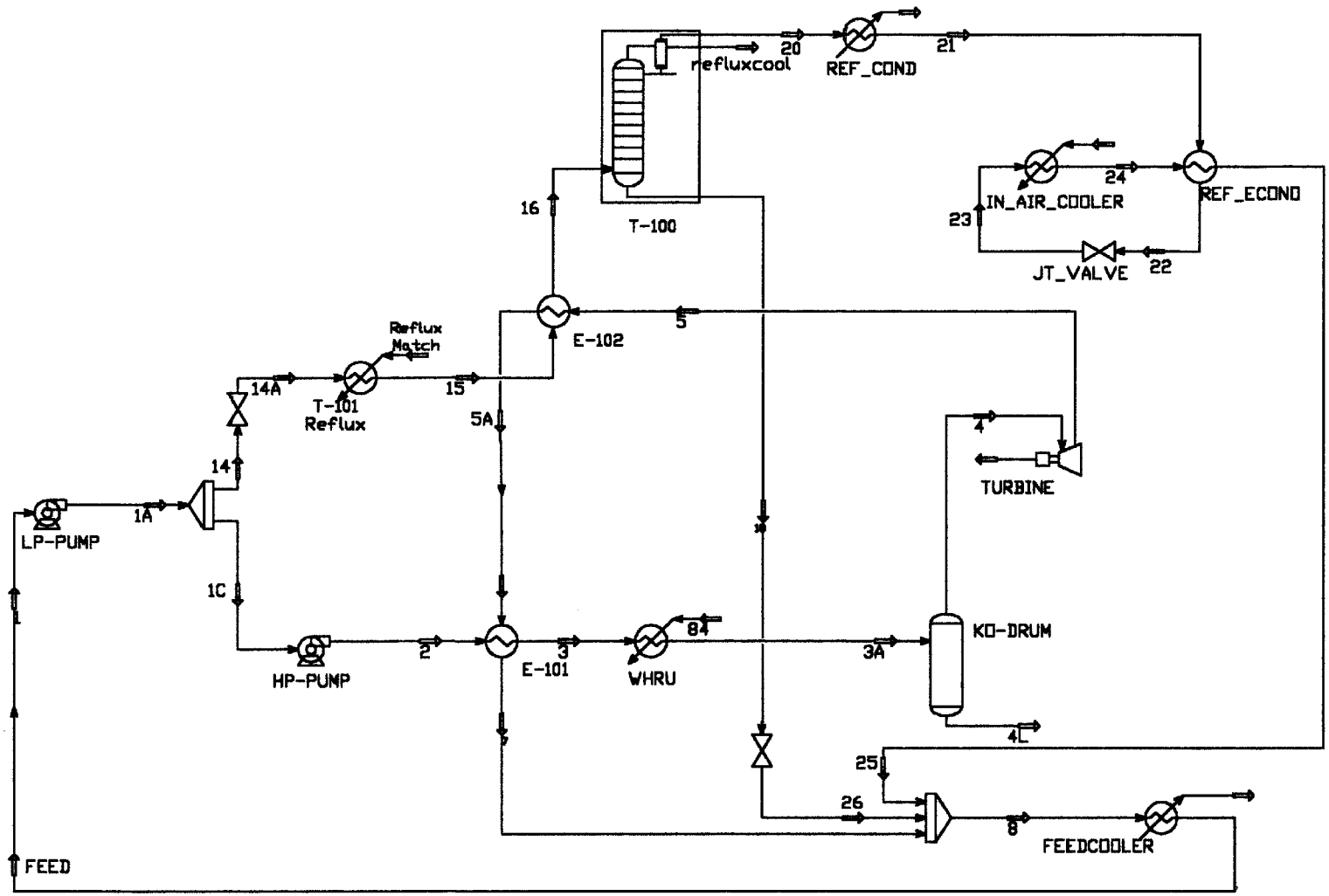
FIG. 1 is a flow diagram of the basic process.

Turning to FIG. 1, a gas turbine waste heat power recovery and inlet air thrust augmentation cooling system is illustrated. This example is provide to illustrate the operation of the invention and not as a limitation of the general method. It should be understood that the general method is applicable to any process in any setting wherein waste heat can be recovered such as by conversion to mechanical horsepower or process heat while also providing a useful refrigeration capacity. The example assumes a typical gas turbine with the following basic parameters:

Inlet air flow rate at 95° F. ambient temperature of 136,000 pounds/hour

Exhaust flow rate at 95° F. ambient temperature of 138,200 pounds/hour

Exhaust temperature at 95° F. ambient temperature of 850° F.

Gross power output of 4,026 Horsepower at 95° F. ambient temperature

Inlet air flow rate at 45° F. inlet air temperature of 149,800 pounds/hour

Exhaust flow rate at 45° F. inlet air temperature of 151,800 pounds/hour

Exhaust temperature at 45° F. inlet air temperature of 805° F.

Gross power output of 5,060 Horsepower at 45° F. inlet air temperature

Ambient conditions of 95° F. dry bulb (DB) and 80° F. wet bulb (WB)

In FIG. 1 a multi-component working fluid stream 1, preferably aqueous ammonia in this example 42 mole percent ammonia and 58 mole percent water, from the feed cooler is pumped to an intermediate pressure in the range of 100 to 500 psia, preferably 200 to 350 psia most preferably about 270 psia. The working fluid stream is divided into two streams, a first stream (14) flowing to the refrigerant still and a second stream (1C) flowing to the inlet of a second (high pressure) pump and being boosted to a working pressure in the range of 400 to 1800 psia, preferably 500 to 1000 psia, and in the example about 800 psia and then through economizing heat exchanger (E-101) and into a waste heat recovery unit (WHRU). The waste heat recovery unit in this example is located in the gas turbine exhaust and cools the turbine exhaust to about 280° F. while vaporizing the working fluid (3–3A), preferably in multiple stages as in example 3. The slightly superheated working fluid is then work expanded down to about 68 psia through an energy recovery means such as an expansion turbine in this example which may drive a compressor, generator, pump or other device. Most commonly, the turbine drives a generator or compressor. When the system operates at the example temperatures and pressures the turbine produces about 1282 horsepower. The expanded solution is condensed and may optionally pass through additional heat exchangers to more completely recover the heat and boost operating efficiency. In the embodiment illustrated in FIG. 1 the stream is condensed through two economizing cross-exchangers (E-102 & E-101) and an air-cooled condenser before flowing back to the first (low pressure) pump.

Stream (14) from the first (low pressure) pump (LP) flows through a dephlegmator in the top of the refrigerant still (T-100) to reflux and separate the more volatile component of the working fluid, preferably ammonia, while heating the working fluid (14A–15). The stream is further heated and partially vaporized, preferably in a cross-exchanger such as E-102 (15–16) by cross-exchange with the output from the expansion turbine. Preferably, the system will be operated such that the outlet stream temperature from the expansion turbine will be great enough to partially vaporize the refrigerant stream (15–16). With a 68 psia turbine discharge, for example, and assuming a 75% turbine efficiency, the turbine exhaust will be about 266° F., the turbine will operate with an exhaust temperature in the range of 150 to 400° F., preferably 200 to 300° F. If the vaporizing refrigerant stream (16) leaves the exchanger at 256° F., about 18% of the stream will be vaporized. The vaporized stream is further distilled in the refrigerant still to produce the more volatile component as essentially a single component. In this example using ammonia, a purity of about 99.5% is selected, purity may be in the range of 90 to 99.9%, preferably over 99%. In the example, the ammonia is condensed in the air cooler at 110° F. The purified, condensed volatile component flows to an expansion device, preferably a Joules-Thompson valve, where it is expanded to a lower pressure in the range of 30 to 90 psia, preferably 45 to 75 psia cooling the vapor stream to the range of 60 to 10° F. preferably 50 to 30° F. and to about 37° F. in the example.

The cooled vapor flows through refrigeration coils to provide cooling. In the example, the cooled vapor is routed to cool the turbine inlet air to about 45°. The turbine inlet may be cooled to the range of 75 to 10° F., preferably in the range of 50 to 40° F. When the inlet air is cooled to 45° F. on a day when the ambient air is 95°, the turbine produces about 1035 additional horsepower due to the inlet air cooling.

The stream leaves the inlet air coils (24) and flows through the refrigerant economizer (or alternative type heat exchanger) (25) and is mixed with the less volatile component as a liquid stream from the refrigerant still (T-100) and the partially condensed turbine exhaust stream and the combined mixed stream is directed to the feed cooler. Under the example conditions, the feed cooler will operate at 110° F. and about 68 psia, the refrigerant ammonia (25) is reabsorbed into the mixed liquid streams from the expansion turbine (7) and the refrigerant still (18) to complete the cycle. The liquid is pumped by the first (low pressure) pump to begin the cycle again. The basic system illustrated here can be enhanced by many refinements known to those skilled in the art. The system may be added to the method of example 1 using an appropriate simulation program to compute the required design parameters. The use of cooling water in lieu of ambient air cooling will add to the overall efficiency. Assuming a 95° F. DB/80° F. WB ambient day will allow an 85° F. cooling water temperature from a cooling tower. This, in turn, will allow a 95° F. feed cooler outlet temperature, assuming a 10° F. minimum approach temperature. This, in turn, allows the pressure at the feed cooler to be lowered to 54.8 psia. Alternatively this allows a lower concentration of volatile component, such as ammonia and increases the power output by approximately 52 horsepower.

Other pumping arrangements can be envisioned to provide the fluid flow to the refrigerant still (T-100) separately from the high pressure stream to the heat source such as a waste heat recovery unit in the example.

An intermediate fluid circulating loop can be envisioned exchanging heat with the refrigerant stream and providing refrigeration to cool the inlet air to the gas turbine or to provide refrigeration to other refrigeration loads. The intermediate fluids could be water, brine, glycol brines, alcohol brines, hydrocarbons, or a variety of other fluids.

While gas turbine inlet air cooling is useful seasonally, other uses of the refrigeration may be even more valuable on a year round basis. The refrigeration cooling can be employed for comfort cooling, process cooling, quick freezing of foods, partially condensing hydrocarbon streams to recover natural gas liquids, for natural gas BTU reduction, flare gas BTU reduction, tank immersion/jacket coolers and the like.

Alternatively the invention may be viewed as combined apparatus and conduits configured to carry out the preceding process; or as method of design for selecting the process parameters to configure a system to practice the preceding process. In the design method, it is preferred to use an engineering process system simulator such as the HYSYS Simulator that may be obtained from Hyprotech, of Houston, Tex., who may also be contacted by the internet at their website, www.hyprotech.com.

EXAMPLE 2

Figure 2:
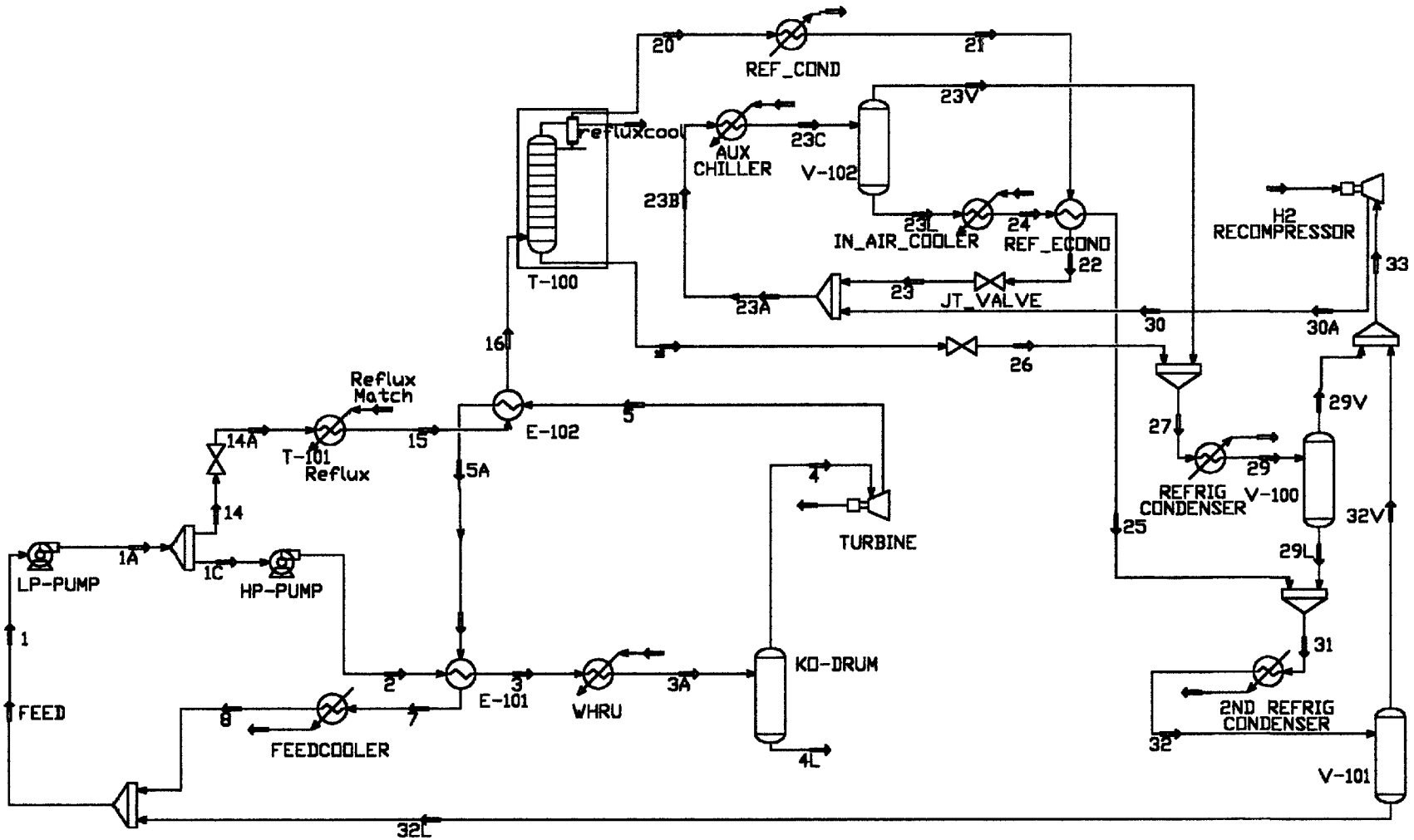
FIG. 2 is an alternative embodiment adding an additional volatile feed to refrigeration loop.

FIG. 2 illustrates an alternative embodiment wherein a volatile component (30) such as an inert gas or in a preferred mode, hydrogen is added and mixed with the vaporized component from the refrigeration still (T-100) at a mixer (MIX-100) to provide mixed stream 23A which is heated through a cross exchanger (AUX Chiller), separated in knockout vessel V-102 to provide stream 23V which mixes with liquid stream 18–26 from refrigeration still (T-100) at mixer (MIX-101) passes through refrigeration condenser 27–29 to knockout vessel V-100 where it separates to vapor stream 29V and liquid stream 29L. Stream 29V passes through mixer (MIX-104) via 33 to a re-compressor and returns to recycle as stream 30. Stream 29L passes to a mixer (MIX-103) where in combines with the liquid stream 25 from vessel (V-102) which has been further vaporized by passage through the inlet air cooler (24) and a refrigeration economizer (25) the combined liquid stream 31 passes through a second refrigerant condenser and the effluent (32) flows to knockout pot V-101 where the vapor separates to provide stream 32V which combines with Stream 29V at mixer (MIX-104) to yield stream 33 passing to the re-compressor. The liquid stream 32L passes to mixer (MIX-102) where it combines with stream 8 to form the feed passing into the low pressure pump. The inert stream lowers the partial pressure of the volatile component thereby lowering its vaporization pressure/temperature. When combined with the circuit of example 1 the refinement allows a lower refrigeration temperature for a given composition and evaporating pressure.

The basic system illustrated here can be enhanced by many refinements known to those skilled in the art. By appropriately selecting equipment elevations, fluid static head can be used in place of the alternate volatile component (30) recompresser. Alternatively, additional levels of heat exchange can be added to optimize the system, as illustrated in the following example.

EXAMPLE 3

Figure 3:
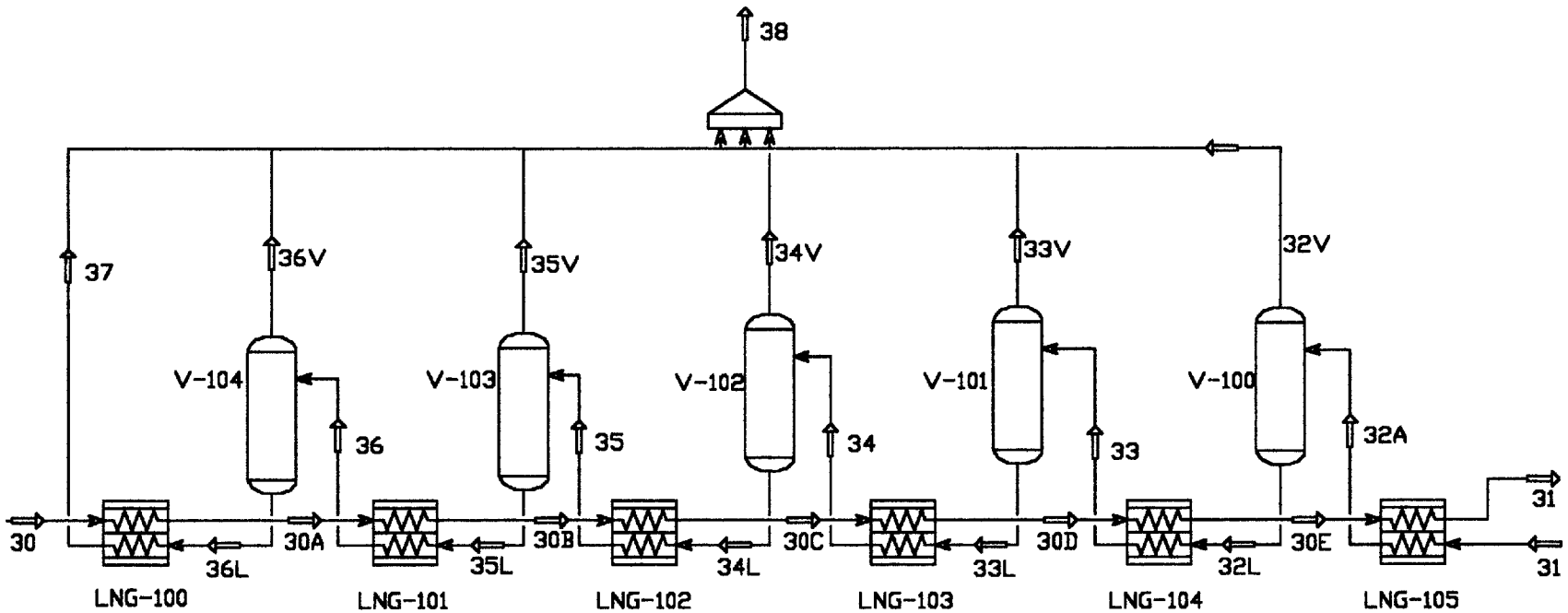
FIG. 3 is a flow diagram simplified to show only the sequential heat exchange of a preferred embodiment that may be used with the process of example 1.

Turning to FIG. 3 a sequential cooling of heat containing stream 30 is illustrated. Stream 30, which may be the energy containing stream to be recovered in the preceding examples, enters heat exchanger LNG-100 at an example temperature of 805° F. This example illustrates the parameters for a stream of gas turbine exhaust air at 5325 lbmoles/hr and 14.7 psia which heats the working fluid stream 36L from the inlet temperature of 495.4° F. of at a flow rate of 267.5 lbmole/hr to the heated and vaporized to stream 37 of about 6.01 mole percent ammonia and 93.99 mole percent water exiting at 551.5° F. while stream 30 exits the exchanger LNG 100 as 30A at 717.5° when the initial working fluid 32 is 42 mole percent ammonia and 58 mole percent water and stream 32–37 is operated at about 800 psia, in the example 793 psia. Stream 30A enters LNG-101 at 717.5° F. and is cooled to an exit temperature of 630° F. while heating stream 35L from 464.2° F. to 495.4° when the stream flow is 534 lbmoles/hr, and a vapor stream 36V of 266.6 lbmoles/hr of 20.38 mole percent ammonia and 79.62 mole percent water is separated from liquid stream 36L of 267.5 lbmoles/hr of 20.38 mole percent ammonia and 79.62 mole percent water at vessel V-104. Stream 36V is combined with stream 37 conveyed to mixer MIX-100 to be combined with the additional streams and work expanded at the energy recovery means then recycled as in example 1. Stream 30 *b* is conveyed to LNG -102 where in enters at 630° F. and exits as 30*c* at 542.5° F. while heating entering stream 34L from 421.4° F. to 464.2° F. Stream 34L of 789.7 lbmoles/hr of 22.44 mole percent ammonia and 77.56 mole percent water is separated at vessel V-103 from 34V of 253.3 lbmoles/hr of 63.83 mole percent ammonia and 36.17 mole percent water when stream 34, 32.49 mole percent ammonia and 67.51 mole percent water at 421.4° F. having a vapor fraction of 24.29 mole percent is fed to vessel V-102. Stream 34V joins the other vapor streams at MIX-100. Stream 30 *c* is conveyed to LNG -103 where in enters at 542.5° F. and exits as 30*d* at 455.0° F. while heating entering stream 33L from 374.5° F. to 421.4° F. as stream 34. Stream 33L consists of 1043 lbmoles/hr of 32.49 mole percent ammonia and 67.51 mole percent water is separated at vessel V-104 from 33V of 259.0 lbmoles/hr of 80.29 mole percent ammonia and 19.21 mole percent water when stream 33 at 42 mole percent ammonia and 58 mole percent water at 374.5° F. having a vapor fraction of 19.89 mole percent is fed to vessel V-102. Stream 33V joins the other vapor streams at MIX-100. Stream 30*d* is conveyed to LNG -104 where in enters at 455.0° F. and exits as 30*e* at 367.5° F. while heating entering stream 32L from 329.5° F. to 374.5° F. as stream 33. Stream 32L consists of 1302 lbmoles/hr of 42 mole percent ammonia and 58 mole percent water is separated at vessel V-100 from 32V of 0 lbmoles/hr of 89.95 mole percent ammonia and 10.05 mole percent water when stream 32A, 42 mole percent ammonia and 58 mole percent water at 329.5° F. having a vapor fraction of 0 mole percent is fed to vessel V-100. Stream 32V joins the other vapor streams at MIX-100. Stream 30*e* is conveyed to LNG -105 where in enters at 367.5° F. and exits as 31 at 275.7° F. while heating entering stream 32 from 201.3° F. to 329.5° F. as stream 32A. Stream 32 consists of 1302 lbmoles/hr of 42 mole percent ammonia and 58 mole percent at 793 psia. Those skilled in the art will see that many variations may be made of the invention defined by the claims set out below without departing from the scope or spirit of the invention.

EXAMPLE 4

Figure 4:
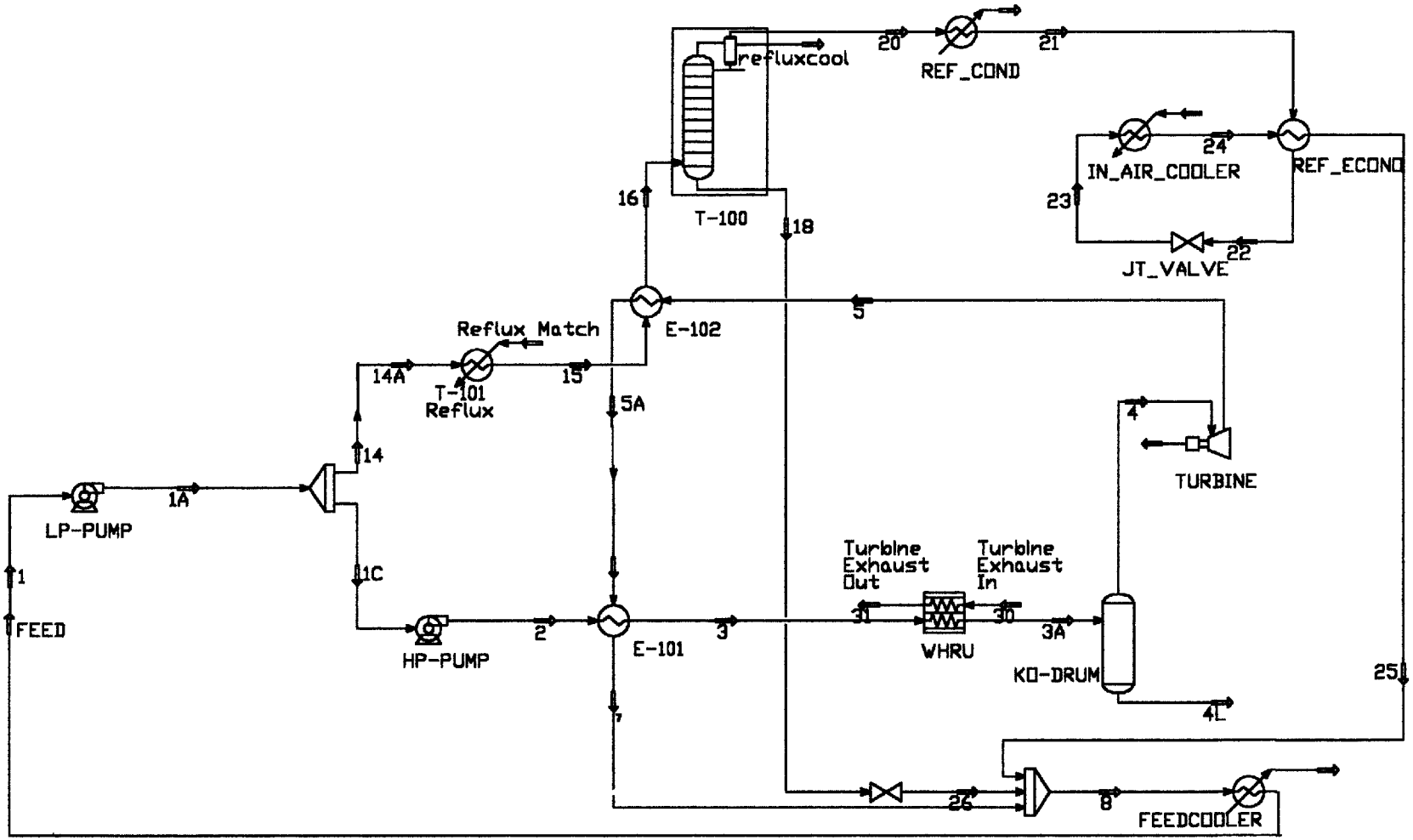
FIG. 4 is a flow diagram of a modification of the basic process employing an areoderivative gas turbine of larger capacity.

Turning to FIG. 4, a gas turbine waste heat power recovery and inlet air thrust augmentation cooling system is illustrated. This example is provide to illustrate the operation of the invention and not as a limitation of the general method. It should be understood that the general method is applicable to any process in any setting wherein waste heat can be recovered such as by conversion to mechanical horsepower or process heat while also providing a useful refrigeration capacity. The example assumes a typical aero derivative gas turbine with the following basic parameters:

Exhaust flow rate at 96° F. ambient temperature of 824,760 pounds/hour

Exhaust temperature at 96° F. ambient temperature of 839° F.

Gross power output of 38,958 Horsepower at 96° F. ambient temperature

Inlet air flow rate at 45° F. inlet air temperature of 1,019,520 pounds/hour

Exhaust flow rate at 45° F. inlet air temperature of 1,050,480 pounds/hour

Exhaust temperature at 45° F. inlet air temperature of 823° F.

Gross power output of 62,956 Horsepower at 45° F. inlet air temperature

Ambient conditions of 96° F. dry bulb (DB) and 78° F. wet bulb (WB)

In FIG. 4 a multi-component working fluid stream 1, preferably aqueous ammonia in this example 47 mole percent ammonia and 53 mole percent water, from the feed cooler is pumped to an intermediate pressure in the range of 100 to 500 psia, preferably 200 to 350 psia most preferably about 225 psia. The working fluid stream is divided into two streams, a first stream (14) flowing to the refrigerant still and a second stream (1C) flowing to the inlet of a second (high pressure) pump and being boosted to a working pressure in the range of 400 to 1800 psia, preferably 500 to 1000 psia, and in the example about 800 psia and then through economizing heat exchanger (E-101) and into a waste heat recovery unit (WHRU). The waste heat recovery unit in this example is located in the gas turbine exhaust and cools the turbine exhaust to about 285° F. while vaporizing the working fluid (3–3A), preferably in multiple stages as in example 3. The slightly superheated working fluid is then work expanded down to about 60 psia through an energy recovery means such as an expansion turbine in this example which may drive a compressor, generator, pump or other device. Most commonly, the turbine drives a generator or compressor. When the system operates at the example temperatures and pressures the turbine produces about 71,250 horsepower. The expanded solution is condensed and may optionally pass through additional heat exchangers to more completely recover the heat and boost operating efficiency. In the embodiment illustrated in FIG. 1 the stream is condensed through two economizing cross-exchangers (E-102 & E-101) and a water cooled condenser before flowing back to the first (low pressure) pump.

Stream (14) from the first (low pressure) pump (LP) flows through a dephlegmator in the top of the refrigerant still (T-100) to reflux and separate the more volatile component of the working fluid, preferably ammonia, while heating the working fluid (14A–15). The stream is further heated and partially vaporized, preferably in a cross-exchanger such as E-102 (15–16) by cross-exchange with the output from the expansion turbine. Preferably, the system will be operated such that the outlet stream temperature from the expansion turbine will be great enough to partially vaporize the refrigerant stream (15–16). With a 60 psia turbine discharge, for example, and assuming a 85% turbine efficiency, the turbine exhaust will be about 251° F., the turbine will operate with an exhaust temperature in the range of 150 to 400° F., preferably 200 to 300° F. If the vaporizing refrigerant stream (16) leaves the exchanger at 218° F., about 28% of the stream will be vaporized. The vaporized stream is further distilled in the refrigerant still to produce the more volatile component as essentially a single component. In this example using ammonia, a purity of about 99.5% is selected, purity may be in the range of 90 to 99.9%, preferably over 99%. In the example, the ammonia is condensed in the water cooled Reflux Condenser at 100° F. The purified, condensed volatile component flows to an expansion device, preferably a Joules-Thompson valve, where it is expanded to a lower pressure in the range of 30 to 90 psia, preferably 45 to 75 psia cooling the vapor stream to the range of 60 to 10° F. preferably 50 to 30° F. and to about 29.4° F. in the example.

The cooled vapor flows through refrigeration coils to provide cooling. In the example, the cooled vapor is routed to cool the turbine inlet air to about 45°. The turbine inlet may be cooled to the range of 75 to 10° F., preferably in the range of 50 to 40° F. When the inlet air is cooled to 45° F. on a day when the ambient air is 96°, the turbine produces about 24,000 additional horsepower due to the inlet air cooling. The inlet air chilling duty in this example is approximately 24,600,000 BTU/Hr.

The stream leaves the inlet air coils (24) and flows through the refrigerant economizer (or alternative type heat exchanger)(25) and is mixed with the less volatile component as a liquid stream from the refrigerant still (T-100) and the partially condensed turbine exhaust stream and the combined mixed stream is directed to the feed cooler. Under the example conditions, the feed cooler will operate at 88° F. and about 53 psia, the refrigerant ammonia (25) is reabsorbed into the mixed liquid streams from the expansion turbine (7) and the refrigerant still (18) to complete the cycle. The liquid is pumped by the first (low pressure) pump to begin the cycle again. The basic system illustrated here can be enhanced by many refinements known to those skilled in the art. The system may be added to the method of example 1 using an appropriate simulation program to compute the required design parameters. The use of air cooling in lieu of water cooling will reduce the overall efficiency. Assuming a 96° F. DB/78° F. WB ambient day will allow an 82° F. cooling water temperature from a cooling tower.

EXAMPLE 5

Looking now to FIG. 5, which is similar to FIG. 1 except the heat recover is further optimized to provide additional energy recovery partially vaporize additional refrigerant which in turn provides additional refrigeration. Two stages of an expansion turbine are shown to illustrate, as an example, that multiple expansion stages are possible.

The same example turbine as used in Example 4 is used in this example and again the gas turbine inlet air is chilled to 45° F. The stream 1 working fluid for this example is composed of 47.3 mole % $NH_3$, 52.7 mole % $H_2O$. Two expansion turbines (turboexpander) and (turboexpander2) are arranged in series rather than a single expansion turbine as used in Examples 1, 2 and 4. The high pressure vaporized working fluid enters the first expansion turbine (turboexpander) and the gas expands to the outlet pressure while driving a shaft to generate power. The expansion turbine outlet stream is two phases comprised of both liquid and vapor. This 2-phase stream is separated into a liquid and vapor stream in the interstage separator (TE interstage scrubber). The pressure of the interstage separator was selected to be slightly higher than the low pressure pump discharge or approximately 220 psig in this example. The vapor steam from the interstage separator flows to this second expansion turbine (turboexpander 2) and flows through the expansion turbine, producing work as the working fluid is expandable to approximately 61.6 psia at a temperature of approximately 256° F. The liquid stream (9L) from the interstage separator is routed to a pass (9L) in the reboiler/condenser to provide additional heat for vaporizing the refrigerant feed to the still column, then is mixed with the intermediate pressure working fluid stream which flows to the feed preheater. A multi-pass condenser/still reboiler is added to recover additional heat so that more refrigerant is generated which increases the available refrigeration duty. The liquid from the still (stream 18) and the liquid from the interstage scrubber (stream 9L), along with the second expansion turbine outlet stream (stream 5), are heat exchangers with the intermediate pressure working fluid (stream 15–16) vaporizing approximately 31.3% in the example.

A chilled water recirculating circuit is shown in FIG. 5 as an example. The refrigerant (stream 23–24) is partially vaporized in the water chiller at approximately 32.8° F. at 62.4 psia. This is heat exchanged with the chilled water loop (stream 39–37) to cool the approximately 2,998,500 #/Hr. water stream from 55.4° F. to 38.4° F. The chilled water at 38.4° F. is heat exchanged with gas turbine inlet air to cool it or other refrigeration loads. In the example, a refrigeration load of 52,550,000 BTU/Hr is available. As an example, this is more than enough to cool 2 gas turbine inlet air streams to 45° F.

As noted above alternate embodiments of the invention may be described in terms of the apparatus configured to carry out the process as described above comprising

We claim:

1. A method of recovering energy which comprises:

a. providing a selected working fluid comprising at least two components to a first pump;

b. feeding the selected working fluid to a dividing means;

c. dividing the working fluid into a first stream and a second stream, d. feeding the first stream at an intermediate pressure to a first heat transfer zone to transfer heat to the working fluid stream thereby heating the stream to a higher temperature, e. feeding the higher temperature stream to a separation means, f. separating a volatile component enriched stream and a volatile component depleted stream;

g. cooling the volatile component enriched stream;

h. further cooling the volatile component enriched stream in a heat exchanger;

i. feeding the volatile component enriched stream to an expansion means;

j. expanding the volatile component enriched stream to a lower temperature and pressure;

k. feeding the expanded lower temperature and pressure volatile component enriched stream to a heat exchanger where the volatile enriched stream is partially or completely vaporized by heat exchange while absorbing heat from an external stream;

l. feeding the at least partially vaporized volatile component enriched stream to a heat exchanger;

m. feeding the volatile component enriched stream to the mixing means;

n. feeding the volatile component depleted stream to the mixing means;

o. feeding the second working fluid stream to a second pump and increasing the pressure of the second working fluid stream to a high pressure;

p. feeding the high pressure second working fluid stream to a second heat exchange zone wherein heat is transferred to the high pressure second working fluid stream to produce a higher temperature and pressure condition of the second working fluid stream;

q. work expanding the higher temperature and pressure second working fluid stream to convert a portion of the heat energy to mechanical energy;

r. returning the second working fluid stream to the mixer; and s. repeating the cycle as set out above.

2. The method of claim 1 which further comprises:

a. feeding the second working fluid through one or more heat exchangers to recover heat while heating this stream;

b. feeding the work expanded second stream to the mixing means;

c. mixing the streams to provide a combined working fluid stream;

d. cooling and condensing the combined working fluid stream by heat exchanging with a bulk heat sink such as ambient air or water; and e. returning the combined working fluid stream to the feed-line of the low pressure pumping stage to provide the selected working fluid.

3. A method according to claim 1 wherein the selected working fluid is selected from the group consisting of ammonia and water; sulfur dioxide and water; mixed hydrocarbons; ammonia and brine; or sulfur dioxide and brine.

4. A method according to claim 1 wherein the selected working fluid comprises ammonia and water.

5. A method according to claim 3 wherein the selected working fluid consists essentially of ammonia and water.

6. A method according to claim 1 wherein the volatile component enriched stream is substantially a pure component.

7. A method of claim 1 wherein at least one of the heat exchange steps is carried out with a cross economizer type exchanger.

8. A method according to claim 1 further comprising feeding the expanded volatile component enriched stream to a second mixing means and feeding a third component into the second mixing means to provide a mixed components stream and feeding the mixed components stream to a refrigerant condenser, separating the mixed components and recycling the separated components.

9. A method according to claim 1 further comprising providing multiple expansion means in series relationship and expanding the volatile component to provide a series of partially condensed working fluid intermediate fractions and passing such intermediate fractions to a reboiler.

10. An energy recovery apparatus that comprises:

a. fluid conduit means connecting all components listed below;

b. a vessel for receiving a working fluid;

c. a dividing means positioned between said vessel and a low pressure pumping means;

d. a low pressure pumping means connected to receive a divided portion of a working fluid and connected on the pressure side to a first heat transfer means;

e. a separation means operably connected to the first heat transfer means and configured to separate a more volatile component of the working fluid from a less volatile component of the working fluid, having a discharge point for discharging a separated more volatile component and a discharge point for the less volatile component;

f. a heat transfer means positioned to receive the more volatile component from the separation means;

g. an expansion means connected to the heat transfer means and configured to receive a cooled more volatile component from the heat transfer means and expand said component to a lower pressure zone, thereby lowering the temperature of the more volatile component;

h. a mixing means operably connected to the separation means and configured to receive the less volatile component from the separation means and the more volatile component from the expansion means;

i. a high pressure pump means connected on its suction side to the dividing means and configured to receive a portion of the selected working fluid and connected on its high pressure side to a second heat transfer means;

j. work expansion means connected to the second heat transfer means on its high pressure side and to the mixing means on its low pressure side;

k. a heat sink means configured to provide a fully liquefied working fluid for feeding to the dividing means;

l. a working fluid comprising at least one more volatile component and a less volatile component in a ratio such that the at least one more volatile component is vaporized by heat available from the energy to be recovered in sufficient quantity to provide the desired product temperature when expanded in the expansion means while the combined working fluid can be fully condensed by the available heat sink means at pressures acceptable in the heat sink means.

11. An apparatus according to claim 10 further comprising:

a. a second mixer connected by fluid conduit means to the volatile component expansion means to receive the expanded more volatile component stream and a third component;

b. a conduit means to convey a mixed components stream to a refrigerant condenser and c. a separating means in fluid communication with the refrigerant condenser and a fluid conduit means for recycling the separated components to the second mixing means.

12. A system for energy recovery that combines an absorption refrigeration capacity with an energy recovery system using a multi-component working fluid having a less volatile component and a more volatile component that can be separated using heat from the energy recovery system to provide a more volatile component stream in a sufficient quantity to provide a desired product temperature in the absorption refrigeration system while simultaneously serving as a multi-component working fluid in the energy recovery system on recombination with the less volatile component to provide a recombined stream that can be fully condensed in a selected heat sink and be sufficiently vaporized by the quantity of energy to be recovered in the energy recovery system; the quantity of energy, usually heat, available to be recovered, the desired product temperature in the refrigeration system and the available heat sink capacity for condensing the working fluid defining the requirements for a mass flow rate, latent heat of vaporization, temperature and pressure conditions of the multi-component working fluid.

13. The system of claim 12 wherein the multi-component working fluid is selected from the group consisting of: ammonia and water; sulfur dioxide and water; mixed hydrocarbons; ammonia and brine; or sulfur dioxide and brine.

14. A method for designing an energy recovery system to provide enhanced energy recovery while at the same time providing an integrated refrigeration capacity that comprises the steps of defining a desired product temperature in the refrigeration system, defining an available heat sink, defining a quantity of energy to be recovered in an energy recovery system, defining a means for converting the quantity of energy to be recovered into a recovered energy output while also providing sufficient heat energy to separate a sufficient quantity of the more volatile component of a portion of the working fluid to provide cooling to the defined product temperature when evaporated and a less volatile component such that when the components are recombined and mixed with a second portion of the working fluid stream from the energy recovery system, the mixed fully combined working fluid stream will be fully condensed by the defined heat sink, defining a group of conditions to be met by a multi-component working fluid, the fully condensed working fluid being divided into at least a first portion and a second portion, the first portion being substantially vaporized by contacting the energy to be recovered thereafter driving the means for energy recovery while also providing heat to separate the more volatile component from the second portion in a selected separation means and when the first portion and second portions are recombined be fully condensed by the defined heat sink capacity.

15. An apparatus for use in an energy recovery apparatus of claim 8 that comprises a plurality of heat exchangers each operating at a different temperature and working fluid composition as a more volatile portion of a multi-component working fluid is sequentially partially vaporized, and fed to one of a plurality of separating means wherein the vapor is separated and the less volatile component is fed to a subsequent heat exchanger, and further comprising means for conducting the vaporized more volatile component to an energy conversion means such that the heat exchangers configured to operate over a range of temperature conditions.

* * * * *